US010495380B2

(12) United States Patent
Millecamps

(10) Patent No.: US 10,495,380 B2
(45) Date of Patent: Dec. 3, 2019

(54) INDUSTRIAL DRYER FOR PLASTICS POUCHES

(71) Applicant: FEGE, Vouziers (FR)

(72) Inventor: Philippe Millecamps, Vouziers (FR)

(73) Assignee: FEGE, Vouziers (FR)

( * ) Notice: Subject to any disclaimer, the term of this patent is extended or adjusted under 35 U.S.C. 154(b) by 114 days.

(21) Appl. No.: 15/643,818

(22) Filed: Jul. 7, 2017

(65) Prior Publication Data

US 2018/0010853 A1 Jan. 11, 2018

(30) Foreign Application Priority Data

Jul. 8, 2016 (FR) ..... 16 56583

(51) Int. Cl.

| | |
|---|---|
| ***F26B 21/00*** | (2006.01) |
| ***F26B 5/00*** | (2006.01) |
| ***F26B 15/10*** | (2006.01) |
| ***F26B 25/00*** | (2006.01) |

(52) U.S. Cl.

CPC ..... *F26B 21/004* (2013.01); *F26B 5/00* (2013.01); *F26B 15/10* (2013.01); *F26B 25/003* (2013.01)

(58) Field of Classification Search

CPC ..... F26B 21/004; F26B 5/00; F26B 15/10; F26B 25/003

USPC ..... 34/500

See application file for complete search history.

(56) References Cited

U.S. PATENT DOCUMENTS 5,222,308 A 6/1993 Barker et al.
5,317,818 A 6/1994 Ward
5,555,648 A * 9/1996 Griffin ..... D06F 59/02 223/67
5,713,137 A * 2/1998 Fujita ..... D06F 58/14 34/106
5,943,786 A * 8/1999 Stahley ..... F26B 21/006 211/41.3
5,992,173 A * 11/1999 Joseph ..... A23L 3/3418 134/131
6,243,967 B1 * 6/2001 Dovolas ..... F26B 25/18 211/13.1
6,243,969 B1 * 6/2001 Yeazell ..... C11D 3/2068 34/340
7,886,459 B2 * 2/2011 Ruess ..... F26B 25/18 134/153

(Continued)

FOREIGN PATENT DOCUMENTS

EP 2803925 A2 11/2014
FR 3053772 A1 * 1/2018 ..... F26B 5/00

OTHER PUBLICATIONS

European Patent Search Report dated Mar. 7, 2017, in corresponding French Patent Application No. 1656583.

(Continued)

*Primary Examiner* — Stephen M Gravini

(74) *Attorney, Agent, or Firm* — Bookoff McAndrews, PLLC

(57) ABSTRACT

A dryer device for drying plastics pouches, the device comprising a main air admission pipe having a plurality of dryer heads including outlet orifices, each outlet orifice forming an air knife, the dryer heads being associated in pairs so as to define a plurality of passages for plastics pouches, each passage being adapted to dry plastics pouches passing therethrough by applying two opposing air knives.

8 Claims, 3 Drawing Sheets

(56) References Cited

U.S. PATENT DOCUMENTS

| | | | | |
|---|---|---|---|---|
| 8,177,097 | B2 * | 5/2012 | Duran | A45F 3/20 222/105 |
| 8,381,413 | B2 * | 2/2013 | Smith | F26B 25/18 211/116 |
| 8,528,232 | B1 * | 9/2013 | Ennis | F26B 21/004 134/12 |
| 8,595,951 | B2 * | 12/2013 | Peet | F26B 9/003 211/12 |
| 9,015,955 | B2 * | 4/2015 | Vezina | D06F 58/14 211/182 |
| 9,341,409 | B1 * | 5/2016 | Akers | F26B 9/003 |
| 9,389,017 | B2 * | 7/2016 | Swart | F26B 9/006 |
| 9,561,893 | B2 * | 2/2017 | Root | B65D 81/245 |
| 9,587,879 | B1 * | 3/2017 | Mersinas | F26B 9/00 |
| 10,197,330 | B2 * | 2/2019 | Stewart | D06F 59/04 |
| 2018/0010853 | A1 * | 1/2018 | Millecamps | F26B 5/00 |

OTHER PUBLICATIONS

Nexgen: "Air Knife Drying Systems and High RPM Centrifugal Blowers", Jul. 7, 2015, URL: http://www.nexgenair.com/pdf/1.pdf (submitted as "XP055351980", 4 pages).

Raico Engineers: "Air Knife Drying System—Beverage Bottle Drying Air Knife System Exporter from Mumbai." Apr. 5, 2016, URL: http://web.archive.org/web/20160405015025/http://www.raicoengineers.net/air-knife-drying-system.html (submitted as "XP055351969", 25 pages) (last accessed Jun. 3, 2017).

* cited by examiner

INDUSTRIAL DRYER FOR PLASTICS POUCHES

CROSS-REFERENCE TO RELATED APPLICATION

This patent application claims the benefit of priority under 35 U.S.C. § 119 to French Patent Application No. 1656583, filed on Jul. 8, 2016, the entirety of which is herein incorporated by reference.

TECHNICAL FIELD

The present disclosure relates to the technical field of industrial dryers, finding its application in particular in fabricating plastics pouches that are to contain food preparations for humans or for pets.

BACKGROUND

In industrial methods for fabricating and packaging flexible pouches made of multilayer plastics material (also known as "sachets" or "doypacks") for the purpose specifically of containing foodstuffs for humans or pets, the flexible pouches are initially bulk-sterilized, and they then need to be thoroughly dried before final packaging in containers.

According to known methods, the flexible pouches are bulk-sterilized in perforated racks that are stacked on one another. After being sterilized, the pouches are then transferred onto a conveyor belt by passing them through a dryer, and they are once more transferred in order to be taken to final packaging.

Nevertheless, such a method involves multiple steps of manipulating the pouches, and thus multiple operations of an operator or a machine picking them up and then putting them down, which is penalizing in terms of efficiency and reliability. Such multiple manipulations lead to high risks of the flexible pouches being degraded, thereby reducing the overall efficiency of a production line.

The present disclosure thus seeks to propose an at least partial solution to these problems.

SUMMARY

The present disclosure relates to a dryer device for drying plastics pouches, the device comprising a main air admission pipe having a plurality of dryer heads including outlet orifices, each outlet orifice forming an air knife, the dryer heads being associated in pairs so as to define a plurality of passages for plastics pouches, each passage being adapted to dry plastics pouches, typically multilayer plastics pouches, passing therethrough by applying two opposing air knives.

In an example, the main pipe extends in a longitudinal direction, and has a plurality of dryer heads each extending in a transverse direction perpendicular to the longitudinal direction, the dryer heads being in alignment along the longitudinal direction and each of them defining at least one air knife in the longitudinal direction.

By way of example, the dryer heads are then arranged in pairs, the dryer heads in each pair defining a plurality of passages for plastics pouches and being configured in such a manner as to apply mutually opposing air knives, the air knife formed by each of the dryer heads in a pair being directed towards the other dryer head of the pair under consideration.

Typically, the main pipe has a plurality of slots extending in the longitudinal direction and thus defining a plurality of air knives in the transverse direction.

Typically, each dryer head then comprises a transverse portion extending in the transverse direction and a longitudinal portion extending in the longitudinal direction, the longitudinal portions of the dryer heads being in alignment, and each including a slot extending in the longitudinal direction and facing towards the main pipe, thereby defining a plurality of air knives in the transverse direction.

The present disclosure also provides a system for drying plastics pouches comprising a dryer device as defined above and a gripper device adapted to take hold of a plurality of plastics pouches and to move them through the passages for plastics pouches of the dryer device in a direction that is substantially perpendicular to the direction of the air knives in the passages, whereby each plastics pouch gripped by the gripper device passes through a passage for plastics pouches of the dryer device.

Typically, the gripper device comprises a plurality of suction cups adapted to grip plastics pouches.

The present disclosure also provides a method of drying plastics pouches, the method comprising the following steps:

- a gripping step for gripping a plurality of plastics pouches by means of a gripper device; and
- a conveying step for conveying the plurality of plastics pouches through a dryer device, so that each plastics pouch passes through a passage for plastics pouches in which two opposing air knives are applied over the plastics pouch.

Typically, the gripping step is performed so as to form a plurality of rows of plastics pouches, each row of plastics pouches passing through one of the passages of the dryer device.

Typically, the plastics pouches are moved through the passages for plastics pouches in a direction perpendicular to the direction of the air knives.

BRIEF DESCRIPTION OF THE DRAWINGS

The invention and its advantages can be better understood on reading the following detailed description of various embodiments of the invention given as non-limiting examples. The description refers to the accompanying sheets of figures, in which.

In all of the figures, elements that are common are identified by identical numerical references.

DETAILED DESCRIPTION OF EMBODIMENTS

An embodiment of the device and the system in an aspect of the invention are described below with reference to FIGS. 1 to 5.

Figure 1:
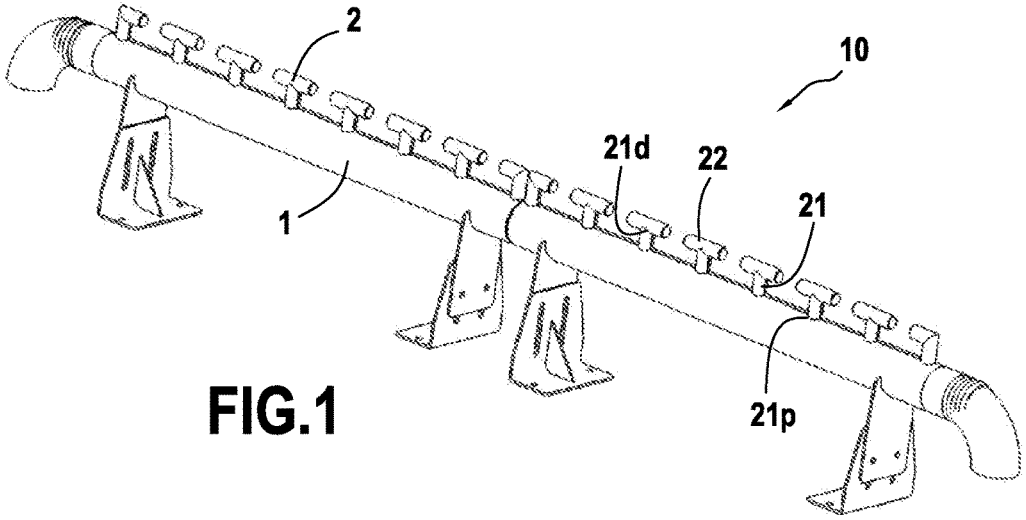
FIGS. 1 and 2 are two views of a dryer device in an aspect of the invention.
Figure 2:
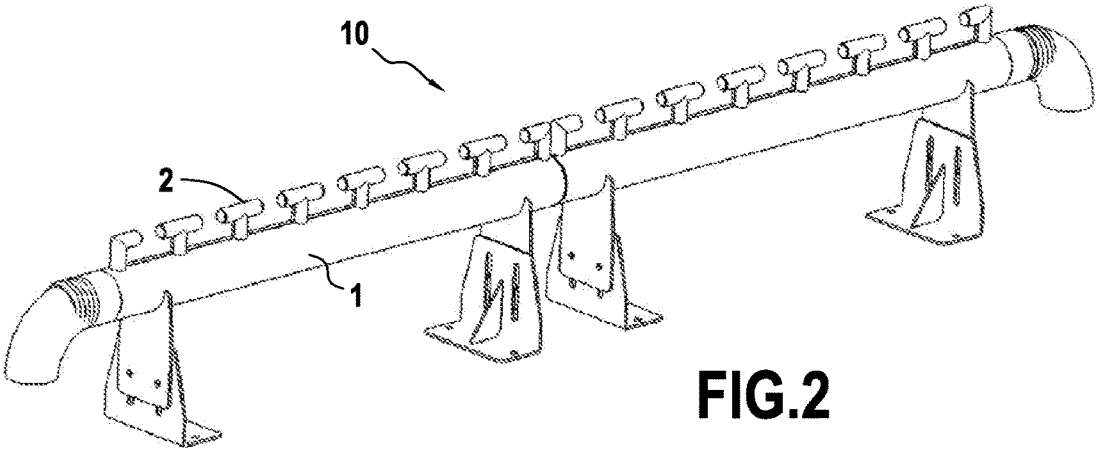

FIGS. 1 and 2 are thus two views of a dryer device 10 in an aspect of the present disclosure.

The dryer device as shown comprises a main pipe 1 forming an air admission, the main pipe having a longitudinal portion extending in a longitudinal direction and being fed with air via at least one of its ends. The dryer device is typically arranged on a plane surface such that the main pipe extends in a horizontal plane. The main pipe 1 may be made up of a plurality of portions connected end to end, each portion possibly then being fed with air independently. Such an embodiment is advantageous in particular in that it makes it possible to obtain a substantially uniform distribution of air for a main pipe 1 of considerable length.

The main pipe 1 is provided with a plurality of dryer heads 2 extending in a transverse direction, perpendicular to the longitudinal direction. The dryer device is typically arranged in such a manner that its transverse direction is a vertical direction, and thus in such a manner that the dryer head 2 extends upwards from the main pipe 1.

In the example shown, these dryer heads 2 are generally T-shaped, with the dryer heads 2 arranged at each end having a T-shape with only one branch. As explained below, the dryer heads 2 are typically arranged regularly on the main pipe, being distributed regularly in the longitudinal direction. The dryer heads 2 are more typically arranged so as to be disjoint, thus defining spacing between two successive dryer heads.

Each dryer head 2 thus has a transverse portion 21 extending in the transverse direction and presenting a proximal end 21*p* connected to the main pipe 1 and a distal end 21*d*, together with at least one longitudinal portion 22 extending from the distal end 21*d* of the transverse portion 21 parallel to the main pipe 1.

Two successive dryer heads 2 thus define a passage that is bounded by the main pipe, by the two transverse portions 21 of the two dryer heads 2, and by two longitudinal portions 22 of the two dryer heads 2.

Figure 3:
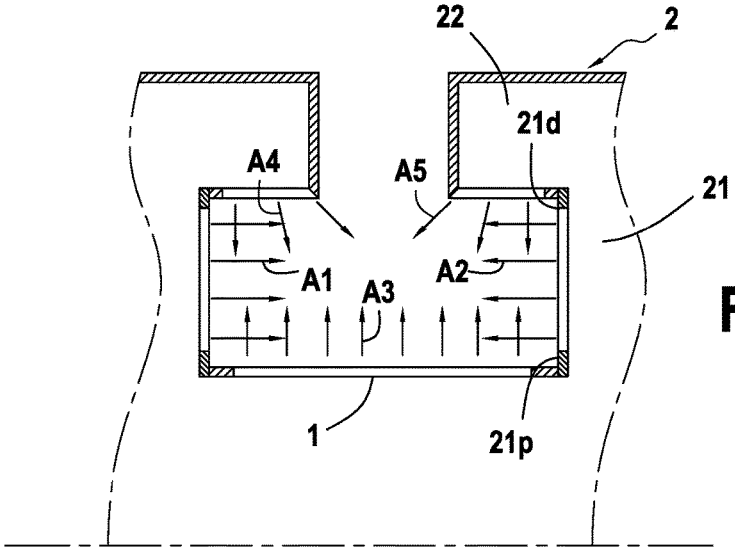
FIG. 3 is a diagram showing the air knives generated by such a dryer device.

FIG. 3 shows one such passage diagrammatically.

The various dryer heads 2 arranged on the main pipe thus act in pairs to define passages as described above. The number of passages as formed in this way thus depends on the number of dryer heads 2 arranged on the main pipe 1, and may be modified as a function of the desired drying rate.

The dryer device is configured so as to generate a plurality of air knives pressing against an article that passes through any one of the above-described passages.

Each of the dryer heads 2 thus presents at least one slot configured to form an air knife going towards the passage defined by the dryer heads 2 in question, the air knife coming from a feed of air provided by the main pipe.

A plurality of slots may be arranged in each passage so as to define a plurality of air knives in each passage.

Each dryer head 2 typically presents at least one slot arranged in the transverse direction, formed in the transverse portion of each dryer head 2, and oriented towards the associated dryer head that defines the passage. Each pair of dryer heads 2 defining a passage thus forms two air knives oriented along the longitudinal axis and flowing in opposite directions, as represented by arrows A1 and A2 in FIG. 3.

Each dryer head 2 may also include one or more slots arranged in its longitudinal portion(s) 22. Such slots are typically formed so as to extend along the longitudinal axis, and are oriented towards the main pipe 1. In the diagram of FIG. 3, such slots thus serve to define air knives identified by arrows A4. These slots formed in the longitudinal portion(s) 22 are typically formed so as to extend to the free end of the corresponding longitudinal portion 22, the slot then being beveled so that the end of the air knife formed in this way is inclined to form an open angle. Such an embodiment makes it possible to apply an air knife over a zone corresponding to the gap between two successive longitudinal portions 22.

The main pipe 1 may also have one or more slots extending in its longitudinal direction, e.g. between two successive dryer heads 2, so as to form one or more air knives in the passage formed by these two dryer heads. In the embodiment shown in the figures, the main pipe thus presents a slot between each pair of successive dryer heads 2, these slots extending in the longitudinal direction through the top of the main pipe, thus enabling an air knife identified by arrows A3 in FIG. 3 to be formed, which knife opposes the air knives identified by above-described arrows A4.

The passages defined by the main pipe 1 and the dryer heads 2 are dimensioned so as to be suitable for passing a plastics pouch, e.g. made of multilayer plastics material, typically following a step of sterilizing the plastics pouches, in order to dry them by means of the air knives.

Each flexible pouch passing through one of the passages as defined in this way is thus dried by the action of the multiple air knives formed in each passage.

Figure 4:
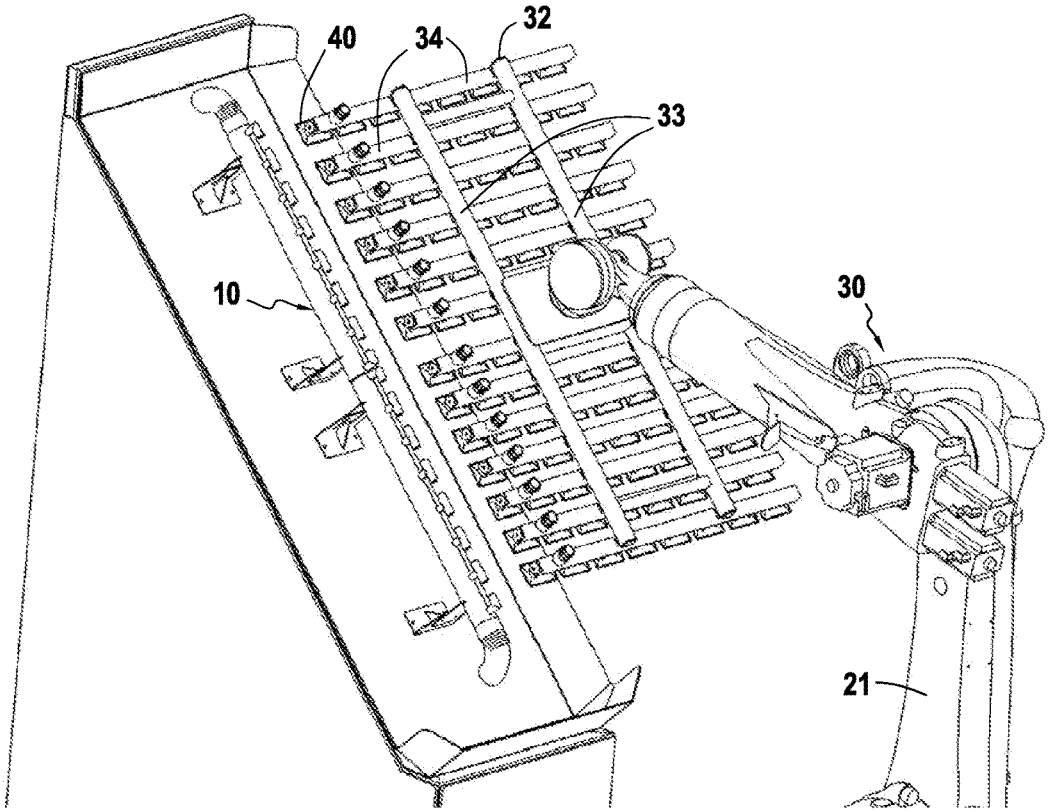
FIG. 4 shows a system associating such a dryer device with a gripper device.

FIG. 4 shows a system comprising a dryer device 10 as shown above with reference to FIGS. 1 to 3 in association with a gripper device 30.

The gripper device 30 as shown comprises a hinge arm 31 holding a gripper grid 32 suitable for taking hold of and holding in position a plurality of plastics pouches 40.

In the example shown, the gripper grid comprises two support bars 33 and a plurality of gripper bars 34. The support bars 33 form a framework to which the gripper bars 34 are fastened.

Each gripper bar 34 is provided with a plurality of gripper elements 35 such as suction cups, suitable for gripping the plastics pouches 40 and holding them in position. The gripper elements 35 are arranged in line on the gripper bars 34, thus making it possible to form rows of plastics pouches 40. Once the rows of plastics pouches 40 have been formed, the gripper device 30 moves the gripper grid 32 so that each row of plastics pouches 40 passes through a passage of the dryer device 10. The gripper grid 32 thus typically moves in translation in a horizontal plane, more generally in a plane perpendicular to the plane defined by the transverse direction in which the dryer head 22 of the dryer device 10 extends.

Figure 5:
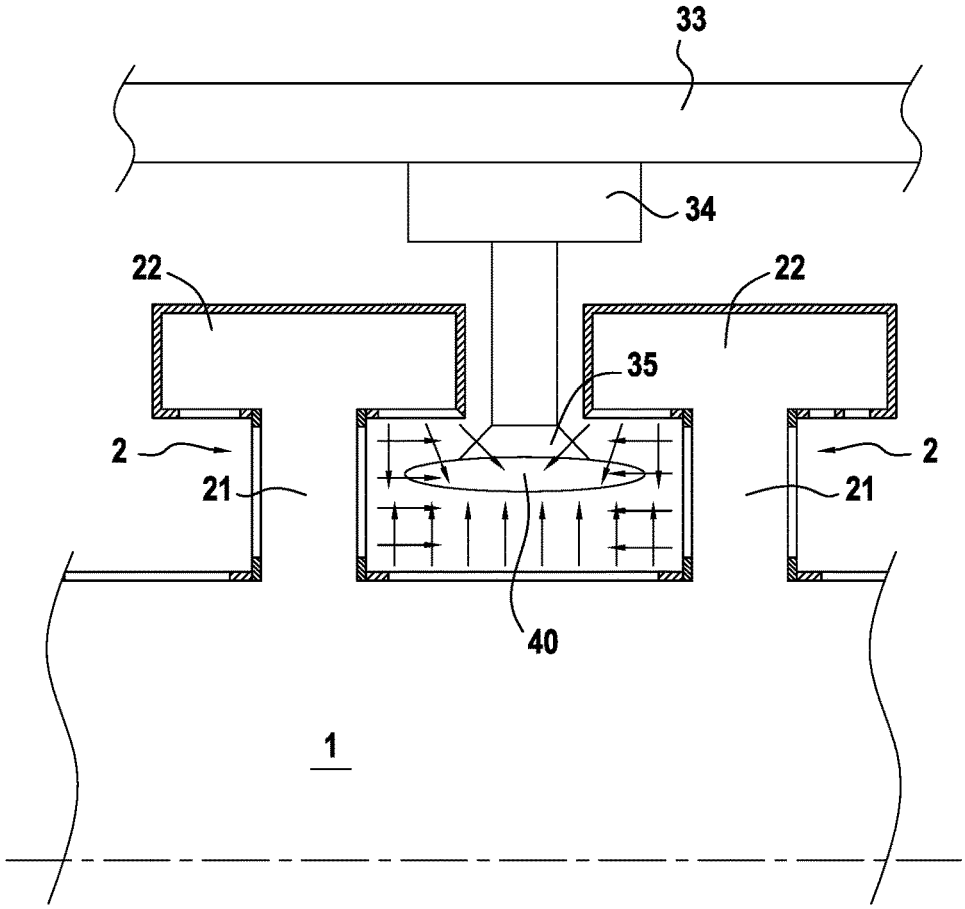
FIG. 5 is a diagram of a plastic pouch passing through such a dryer device.

FIG. 5 is a diagram showing a plastics pouch 40 as held by the gripper device 30 passing through a passage in the dryer device 10. FIG. 5 is similar to FIG. 3; elements in common are thus not described again. The spacing between the longitudinal portions 22 of two successive dryer heads 2 serves to pass gripper elements 35.

As can be seen in this figure, each plastic pouch 40 that passes through a passage defined by the dryer device 10 is thus subjected to a plurality of air knives formed by the main pipe 1 and by the dryer heads 2, thus making it possible to remove any drops that might still be present on the plastics pouch after a sterilization step. Drops present on a plastics pouch 40 are blown off the surface of the plastics pouch 40 by the various air knives.

As shown diagrammatically in this figure, it can be seen that only a small portion of the plastics pouch 40 is masked by the gripper device 35. The major portion of the surface of the plastics pouch 40 can thus be dried by the air knives, and it can thus be considered that the plastics pouch is completely dried after it has passed through a passage as defined by the main pipe 1 and by the dryer heads 2.

The gripper device 30 is thus adapted to take hold of a plurality of plastics pouches 40 and then successively cause them to pass through the passages of the dryer device 10, and then put them down, e.g. on a conveyor for a subsequent step such as filling the plastics pouches 40 or taking them to a storage zone.

The system as described thus makes it possible to minimize the number of steps required for drying plastics pouches 40, and in particular to minimize the number of steps in which the plastics pouches 40 are taken hold of and put down. Specifically, a single gripping step is needed, with the plastics pouches 40 subsequently being dried in a single step as a result of the configuration of the dryer device 10. Such a small number of steps in which the plastics pouches 40 are gripped is advantageous in terms of reliability, and serves to reduce any risk of the plastics pouches 40 being deteriorated. Furthermore, limiting the number of operations of gripping the plastics pouches 40 in this way serves to reduce the number of pouches that are rejected as a result of faulty gripping, or as a result of the plastics pouches 40 being dropped while they are being moved.

The system as proposed is also much more compact than conventional dryer systems, and thus makes it possible to shorten the production line. The footprint on the ground of the system as shown is specifically very small.

The system as described finds a particular application in preparing plastics pouches that are to contain food preparations for humans or for pets.

Although the present invention is described with reference to specific embodiments, it is clear that modifications and changes may be made to those examples without going beyond the general ambit of the invention as defined by the claims. In particular, individual characteristics of the various embodiments shown and/or mentioned may be combined in additional embodiments. Consequently, the description and the drawings should be considered in a sense that is illustrative rather than restrictive.

It is also clear that all of the characteristics described with reference to a method can be transposed, singly or in combination, to a device, and vice versa, with all of the characteristics described with reference to a device being capable of being transposed, singly or in combination, to a method.

What is claimed is:

1. A system for drying plastics pouches, the system comprising:

a dryer device, the dryer device comprising a main air admission pipe having a plurality of dryer heads including outlet orifices, each outlet orifice forming an air knife, the dryer heads being associated in pairs so as to define a plurality of passages for plastics pouches, each passage being adapted to dry plastics pouches passing therethrough by applying two opposing air knives, and a gripper device adapted to take hold of a plurality of plastics pouches and to move the plastics pouches through the passages for plastics pouches of the dryer device in a direction that is substantially perpendicular to the direction of the air knives in the passages, whereby each plastics pouch gripped by the gripper device passes through a passage for plastics pouches of the dryer device.

2. The system according to claim 1, wherein the main pipe extends in a longitudinal direction, and has a plurality of dryer heads each extending in a transverse direction perpendicular to the longitudinal direction, the dryer heads being in alignment along the longitudinal direction and each of the dryer heads defining at least one air knife in the longitudinal direction.

3. The system according to claim 2, wherein the dryer heads are arranged in pairs, the dryer heads in each pair defining a plurality of passages for plastics pouches and being configured in such a manner as to apply mutually opposing air knives, the air knife formed by each of the dryer heads in a pair being directed towards the other dryer head of said pair.

4. The system according to claim 2, wherein the main pipe has a plurality of slots extending in the longitudinal direction and thus defining a plurality of air knives in the transverse direction.

5. The system according to claim 4, wherein each dryer head comprises a transverse portion extending in the transverse direction and a longitudinal portion extending in the longitudinal direction, the longitudinal portions of the dryer heads being in alignment, and each including a slot extending in the longitudinal direction and facing towards the main pipe, thereby defining a plurality of air knives in the transverse direction.

6. The system according to claim 1, wherein the gripper device comprises a plurality of suction cups adapted to grip plastics pouches.

7. A method of drying plastics pouches, the method comprising the following steps:

a gripping step for gripping a plurality of plastics pouches by means of a gripper device; and a conveying step for conveying the plurality of plastics pouches with the gripper device through a dryer device, so that each plastics pouch passes through a passage for plastics pouches in which two opposing air knives are applied over a plastics pouch in a direction that is substantially perpendicular to the direction of the air knives in each passage.

8. The method according to claim 7, wherein the gripping step is performed so as to form a plurality of rows of plastics pouches, each row of plastics pouches passing through one of the passages of the dryer device.

* * * * *